US011486170B2

(12) United States Patent
Bendel

(10) Patent No.: US 11,486,170 B2
(45) Date of Patent: Nov. 1, 2022

(54) DEVICE FOR OPENING A DOOR OR FLAP ON A MOTOR VEHICLE

(71) Applicant: Kiekert AG, Heiligenhaus (DE)

(72) Inventor: Thorsten Bendel, Oberhausen (DE)

(73) Assignee: Kiekert AG, Heiligenhaus (DE)

( * ) Notice: Subject to any disclaimer, the term of this patent is extended or adjusted under 35 U.S.C. 154(b) by 737 days.

(21) Appl. No.: 16/081,963

(22) PCT Filed: Mar. 1, 2017

(86) PCT No.: PCT/DE2017/100161
§ 371 (c)(1),
(2) Date: Oct. 29, 2018

(87) PCT Pub. No.: WO2017/148475
PCT Pub. Date: Sep. 8, 2017

(65) Prior Publication Data

US 2020/0291694 A1 Sep. 17, 2020

(30) Foreign Application Priority Data

Mar. 4, 2016 (DE) ..... 10 2016 103 926.8

(51) Int. Cl.
*E05B 81/90* (2014.01)
*E05B 79/20* (2014.01)
*E05B 85/16* (2014.01)

(52) U.S. Cl.
CPC ..... *E05B 81/90* (2013.01); *E05B 79/20* (2013.01); *E05B 85/16* (2013.01)

(58) Field of Classification Search
CPC ..... E05B 85/10; E05B 85/14; E05B 85/16; E05B 81/90; E05B 79/20; Y10T 292/57; Y10S 292/65
See application file for complete search history.

(56) References Cited

U.S. PATENT DOCUMENTS 5,531,489 A * 7/1996 Cetnar ..... E05B 79/20 292/225
5,887,918 A * 3/1999 Okada ..... E05B 85/10 292/336.3

(Continued)

FOREIGN PATENT DOCUMENTS

DE 19642698 11/2000
DE 102006029774 1/2008

(Continued)

OTHER PUBLICATIONS

"Bowden Cable—Academic Kids," https://academickids.com/encyclopedia/index.php/Bowden_cable, Apr. 30, 2005 (Year: 2005).*

(Continued)

*Primary Examiner* — Alyson M Merlino
(74) *Attorney, Agent, or Firm* — Renner, Otto, Boisselle & Sklar, LLP

(57) ABSTRACT

A device for opening a door or flap on a motor vehicle, comprising a handle that a user can grip from outside the motor vehicle, a motor vehicle locking mechanism, and a means for actuating the locking mechanism using the handle, said actuating means being a cable that is placed between the handle and the motor vehicle locking mechanism.

13 Claims, 4 Drawing Sheets

(56) References Cited

U.S. PATENT DOCUMENTS

| | | | | |
|---|---|---|---|---|
| 6,447,030 | B1 * | 9/2002 | Meinke | E05B 85/16 292/336.3 |
| 7,562,917 | B2 * | 7/2009 | Kohlstrand | E05B 79/20 292/336.3 |
| 8,317,237 | B1 * | 11/2012 | Fannon | E05B 79/20 292/336.3 |
| 8,616,611 | B2 * | 12/2013 | Schidan | E05B 85/12 292/336.3 |
| 10,072,448 | B2 * | 9/2018 | Puscas | E05B 85/16 |
| 2002/0089194 | A1 * | 7/2002 | Nomura | E05B 85/16 292/336.3 |
| 2004/0129040 | A1 | 7/2004 | Mathofer et al. | |
| 2010/0071165 | A1 * | 3/2010 | Costigan | E05B 85/16 16/412 |
| 2016/0160538 | A1 * | 6/2016 | Mathofer | E05B 85/16 292/336.3 |
| 2019/0024422 | A1 * | 1/2019 | Inan | E05B 85/16 |

FOREIGN PATENT DOCUMENTS

| | | | | |
|---|---|---|---|---|
| DE | 202008003845 | | 8/2009 | |
| DE | 102013109912 | | 3/2015 | |
| DE | 202015102697 | U1 | 8/2015 | |
| DE | 102015004985 | | 12/2015 | |
| DE | 102015115221 | | 3/2017 | |
| EP | 1197620 | A2 * | 4/2002 | E05B 79/20 |
| WO | WO-2004033832 | A2 * | 4/2004 | E05B 79/20 |
| WO | WO-2011073271 | A1 * | 6/2011 | E05B 81/78 |
| WO | WO-2012039089 | A1 * | 3/2012 | E05B 85/16 |

OTHER PUBLICATIONS

Search Report of DE Application No. 102016103926.8 dated Dec. 5, 2016.

International Search Report and Written Opinion for corresponding Patent Application No. PCT/DE2017/100161 dated Jun. 16, 2017.

* cited by examiner

DEVICE FOR OPENING A DOOR OR FLAP ON A MOTOR VEHICLE

FIELD OF DISCLOSURE

The invention relates to a device for opening a door or flap on a motor vehicle, comprising a handle that a user can grip from outside the motor vehicle, a motor vehicle locking mechanism, wherein a means for actuating the locking mechanism is arranged between the handle and the motor vehicle locking mechanism.

BACKGROUND OF DISCLOSURE

Motor vehicles are now increasingly equipped with convenience functions. Electrically operated sliding doors, closure aids and/or electrical locks must be stated hereby, for example. Electrical locks, so-called e-locks, are locks or locking systems which are equipped with electrical devices which enable the lock to be opened in an electrically operated manner. For example, by means of an electrical drive in the locking system, a locking mechanism comprising a catch and a pawl, for example, can be electrically unlocked.

In order to open the locking system or the locking mechanism, a mechanical connection is not absolutely required between a handle, such as an external door handle, and the locking system. For this purpose, the handle has an electrical transducer which generates a signal which is in turn transmitted to the locking system, whereby the electrical drive is activated to open the locking system. The door, flap, sliding door or hood can consequently be opened very easily and conveniently.

If a power drop occurs in the motor vehicle, means must be present in order to operate the device for emergency opening. The opening device can thus also be referred to as an emergency opening device for a motor vehicle. In order to now in the case of a power drop, for example, be able to open the motor vehicle respective the components arranged in a moving manner on the motor vehicle different mechanical means have become known, for example, with which an electrically operated lock can be opened in an emergency.

A handle component to open an electrically operated door lock is known from DE 196 42 698 C2, for example. A solution is revealed in which a movably accommodated handle section is firmly connected to the motor vehicle chassis.

The handle section also has a pressure switch which can open the door lock. In customary operation, the handle component is firmly attached adjacent to the external shell of the motor vehicle.

If now, in the case of accident, a power drop occurs, for example, an electromagnet is operated which, in turn, moves a locking bolt so that a pivoting lever is released. This causes a gearwheel to be released with which a Bowden cable is connected. The Bowden cable connected to the gearwheel is mechanically coupled with the door lock so that pulling can occur on the Bowden cable during movement of the gearwheel. The gearwheel interacts with a rack which is attached to the handle component in turn. By means of the release of the gearwheel, the handle component can be pulled out of the external shell of the motor vehicle in a pivoting manner, wherein the rack combs with the gearwheel and pulls on the Bowden cable. In an emergency, mechanical operation of the lock is thus available.

A further handle device is known from DE 10 2006 029 774 A1 to open an electrical lock. A handle element which can be moved on one side is arranged in a static handle component. A sensor is located within the handle element which can transmit a signal to the lock so that during gripping of the handle element an opening command can be transmitted to the electrical lock. The handle element does not absolutely need to be moved to operate the electrical lock. However, in the case of a power drop, mechanical operation of the lock is provided for. The movably arranged handle element interacts with a force locking unit which needs to be overcome in order to activate the mechanical connecting element to the lock. The power locking unit can be a pressurized spring or a ratchet connection, for example.

A device to open a door or a flap of a motor vehicle has become known from the unpublished DE 10 2015 115 221. 5 in which a handle component is arranged in a chassis component in a pivotable manner. The handle component is mounted on one side and can be moved around a slight stroke on the side opposite the accommodation. The stroke is limited, wherein a path limiting means is used which can engage in an electrically operable manner into the handle component or can be moved out of the engagement area of the handle component. During normal operation, the slight stroke of the handle component can operate a sensor element so that an opening signal can be transmitted to the lock. In the case of a power drop and thus impossibility of electrical opening of the lock, the drive unit moves the path limiting means from the engagement area of the handle component, so that a large stroke on the handle component is available in order to mechanically operate the electrical lock in an emergency.

A disadvantage of the solutions known from the state of the art is that a defined mechanical connection must be available between the handle component or the handle to open the door or flap and the lock. In particular, the connection of a Bowden cable with a mechanical and constructional structure is connected, for example.

The object of the invention is to provide an improved device to open a door or a flap. A further object of the invention is to provide an opening device and, in particular, an emergency opening device for a door or flap of a motor vehicle which can be executed with minimal structural means and enables safe operation of the electrical lock in the case of a power drop or outage. A further object of the invention is to provide a structurally simple and cost-effective option to open a door or a flap for operation of electrical locks.

SUMMARY OF DISCLOSURE

The task is solved according to the invention by the characteristics of the disclosure. Advantageous designs of the invention are specified in the disclosure. It is pointed out that the exemplary embodiments described hereafter are not restrictive; instead, any variations are possible of the characteristics described in the description.

The object of the invention is solved by a device for opening a door or flap on a motor vehicle being provided, comprising a handle that a user can grip from outside the motor vehicle, a motor vehicle locking mechanism, wherein a means for actuating the locking mechanism is arranged between the handle and the motor vehicle locking mechanism by means of the handle, wherein the actuating means is a cable. By means of the formation of the actuating means in the form of a cable, the possibility is now created of producing a connection between the handle and the lock with minimum structural means. In particular, a cable is not connected to structural means in order to be attached to the handle component and the cable also does not require a separate guide, such as a sheath, for example.

A cable is furthermore extremely cost-effective and can easily be installed in a lateral door, for example. A connection is thus very easily possible between the electrical lock and the handle component. A range of advantages thus result if a cable is used as an actuating means for the electrical lock in the case of a power drop. On the one hand, easy connection to the handle component and the lock is possible; secondly, installation of the cable is possible without structural aids and, thirdly, the use of a cable is a cost-effective connecting option.

The opening device can be used on a door or flap of a motor vehicle. However, use is not limited to a door or a flap, but can also be used on a front flap and/or cover, for example, such as a Cabrio roof and/or a central armrest. The device can thus be used everywhere where electrically operated locking systems are used in the motor vehicle. A handle is usually pivotably mounted in the form of a handle component in the motor vehicle in order to give the operator the option on the one hand of activating the lock by means of the handle component and, on the other hand, with the handle component simultaneously provides a means in order to manually open a lateral door, for example. However, the handle can also be part of a cover if it is used, for example, on a tailgate. However, the handle must be arranged on the motor vehicle such that it can be gripped from outside of the motor vehicle by the operator in the case of a power drop in the motor vehicle.

As motor vehicle locking mechanisms in the meaning of the invention locking mechanisms and/or locks are to be viewed which are electrically operated, i.e. in which by means of an electrical drive the locking mechanism is unlocked and the lock is disengaged from a lock holder, for example. After electrical operation of the locking device, the door or flap can then be manually and/or electrically opened and/or by means of comparable drives.

The handle is connected to the locking mechanisms. The handle is preferably arranged in an area in which the operator can easily grip the handle so that opening of the cover, flap and/or hood is easily enabled. The handle can execute a slight stroke of 2-3 mm, and is integrated into the chassis at least in part. By means of the handle stroke, a sensor can be operable which transmits a signal to the electronic lock in order to start up an opening mechanism and in particular an electrical motor in order to initialize opening of the locking mechanism. The locking mechanism is then completely opened in a spring-assisted manner and/or by means of flap sealing pressure, for example. In the case of a power drop, no energy is available either for the sensor or for the electrical lock. In the case of a power drop, the lock would be automatically unbolted so that a mechanical unlocking chain is closed so that the lock can be opened mechanically by means of mechanical operation of the lock, for example on an external actuating lever or an internal actuating lever.

In an advantageous configuration of the invention, the cable is made of plastic, at least in places. A plastic cable is flexible on the one hand and thus light and installable without guide elements, such as a sheath. The cable can thus also be mounted over areas which are difficult to access structurally and in a targeted manner between the handle and the lock. As it involves emergency operation which is only used when electrical opening is not available, a structurally elaborate guidance of the cable between the handle and the lock can be dispensed with. A further advantage of use of a cable which is made at least partly of plastic is that hereby a cost-effective means is available with sufficient tensile strength to operate the lock. In particular, use of braided and/or opposite wires hereby offer the advantage that high tensile forces can also be transmitted.

If the cable is made of flexible wire or wire cable, at least in places, a further advantageous design form of the invention results. Flexible wire cables are cost-effective and can be connected to the handle component or the handle and the lock without great structural expense. The highest forces can be transmitted with a wire cable so that in the case of power outage and/or an accident high forces can be transmitted to the lock by means of the handle. The highest forces can be transmitted by means of the wire cable if the wire cable consists of two or more, in particular a large number of wires which are wrapped or twisted with one another. If the actuating means is a flexible wire cable, no structurally elaborate guides are necessary for the wire cable as the wire cable only needs to be operable by means of handle movement.

In an advantageous embodiment of the invention, the handle is pivotably arranged in the motor vehicle. A pivotable arrangement of the handle offers the advantage that a precisely guided handle is available to the operator. In particular, movability of the handle in z-direction of the motor vehicle offers the quality standard so that by means of fixing in the form of accommodation a means is provided with which, on the one hand, a quality characteristic is guaranteed for the handle and, on the other hand, the actuating means can be operated precisely and in a defined manner by means of precise guidance of the handle.

In a further embodiment of the invention, an advantage results if the handle is mounted on one side and is accommodated in a guided manner on a side opposite the mounting. A handle guide simultaneously offers multiple advantages. On the one hand, the handle can be guided on a high to highest quality standard and, on the other hand, guidance of the handle offers the option of guiding the actuating means over a defined path. Handle guidance thus enables very precise movement of the actuating means and, simultaneously, the option of haptic feedback to the operator. A ratchet contour in the guide can serve as haptic feedback, for example, which enables light or heavy or precise guidance of the handle in the guide according to the configuration.

Furthermore, it is advantageous and a further embodiment of the invention that the guide encompasses a stop so that movement of the handle can be limited. Several functions are thus assigned to the guide. On the one hand, the guide can constitute a quality characteristic, on the other hand the haptic feedback can be set by means of the guide and furthermore the option exists of limiting the handle stroke by means of the guide. The guide can be configured such that a depression and/or an elevation is arranged on the handle which interacts with an elevation and/or depression in the guide. By means of a form-fitting accommodation of the handle in the guide thus, on the one hand, the guidance of the handle can be constituted as a quality standard and, on the other hand, the stroke and the haptic feedback can be impacted and definable. The stop can preferably be configured such that the handle or the handle component completes a stroke of 2-3 mm on the side opposite the mounting in a usual operation to activate the electrical lock.

After a 2-3 mm stroke of the handle component, the handle component pushes against a stop in the area of a guide so that the stroke can be limited. By means of the limited stroke, a movement is initiated into the actuating means. However, this stroke is not sufficient to operate an actuating lever, preferably an external actuating lever on the lock such that a mechanical chain is initialized or operated to open the locking mechanism.

Advantageously, the stop is formed of a form-fitting and or force-fitting connection between the handle and the guide. By means of a form-fitting and/or force-fitting connection between the handle and the guide precise and defined guidance of the actuating means can be enabled. The connection defines the haptic feedback for the operator and forms a guidance means for the handle component so to speak.

In a further advantageous embodiment of the invention the guide has a device to deflect the actuating means. In addition to limiting the stroke and the guidance of the handle the guide can thus encompass a further function, namely that the actuating means can be guided at least in the handle area. For example, a guide can be formed as an recess for the cable or deflect the cable in a targeted manner. A guide and/or deflection of the cable offers the advantage that the cable can be guided such that an optimized alignment of the cable can be formed in relation to the electronic lock. The cable can thus, for example, guide over a bridge and deflect or guide the cable in the direction of an actuating lever of the lock. The cable guide can be executed in the form of a boring, for example, through which the cable can be guided. The guide can also be of such a length that the cable can be guided to an actuating lever of the lock. In one embodiment, the guide can also be connected directly to the lock.

If the handle can be moved out of the guide, a further advantageous embodiment of the invention thus results. If a power drop occurs, the handle can thus be moved out of the guide. The guide is equipped such that the handle can be moved out of the guide by means of increased force. The handle comes into contact with the stop during a first slight operation of the handle so that the operator experiences haptic feedback such that the customary or normal actuating path of the handle component is attained. In the case of a power outage, the option is then available to the motor vehicle operator. To pivot the handle component via the stop from the guide. Pivoting of the handle component beyond the actual stop offers the advantage that very great paths or strokes are available to operate the cable and thus the emergency operation of the lock.

If during customary emergency operation, as known from the state of the art, emergency operation paths or strokes of a handle component of 20 mm are used, moving the handle component out of the guide thus creates the possibility of providing far larger strokes or actuating paths for cable operation. On the one hand, this offers the advantage that a defined cable guide and thus precise configuration on a stroke of 15 or 20 mm, for example, can be dispensed with to operate the actuating lever on the lock, whereby by means of moving the handle out of the guide far greater strokes can be executed. Strokes or paths on the handle of greater than 20 mm, preferably greater than 30, even more preferably 40 and 50 mm strokes can be executed on the handle. A defined installation of the flexible cable or a wire can thus be dispensed with which enables a structurally simple configuration of the connection between the handle and the lock. After emergency operation, the handle can simply be inserted into the guide again, whereby the guide then offers limitation in the form of a stop for normal operation again. Emergency operation is thus reversible.

If the handle can be moved out of the guide by means of excess force, a further advantageous embodiment of the invention thus results. In an advantageous manner, the handle can be moved out of the guide by means of excess force. Moving out then occurs by the handle being movable beyond the stop out of the form- and/or force-fitting guide. As moving out of the handle component is possible at any time and thus emergency operation and consequently manual opening of the door and/or flap would be possible at any time, it is advantageous for the invention that the actuating chain is interrupted in the lock for external operation. This can occur by means of bolting of the lock, for example. The electrical lock is thus advantageously present in a bolted form. In the case of a power drop, the bolting then needs to be lifted and the lock unbolted.

In a further embodiment of the invention, the handle can be moved out of the guide after release of the handle by the stop. In addition to moving the handle component out of the guide by means of increased force, the possibility also exists of moving the stop out of the handle area. This can occur, for example, by means of an electrical drive. However, it is also conceivable that the stop can be moved manually out of the engagement area of the handle so that the grip or the handle can be moved out of the guide. In any case, by means of the large path of the handle a cable can be used as an actuating means for the electrical lock, so that a cost-effective and structurally simple emergency actuating means of the electrical lock is available.

The invention is explained in further detail below with reference to the attached drawings on the basis of preferred exemplary embodiments. However, the principle applies that the exemplary embodiments do not restrict the invention, but only constitute advantageous embodiments. The characteristics portrayed can be executed individually or in combination with other characteristics of the description, individually or in combination.

BRIEF DESCRIPTION OF DRAWINGS

The following are shown.

Figure 1:
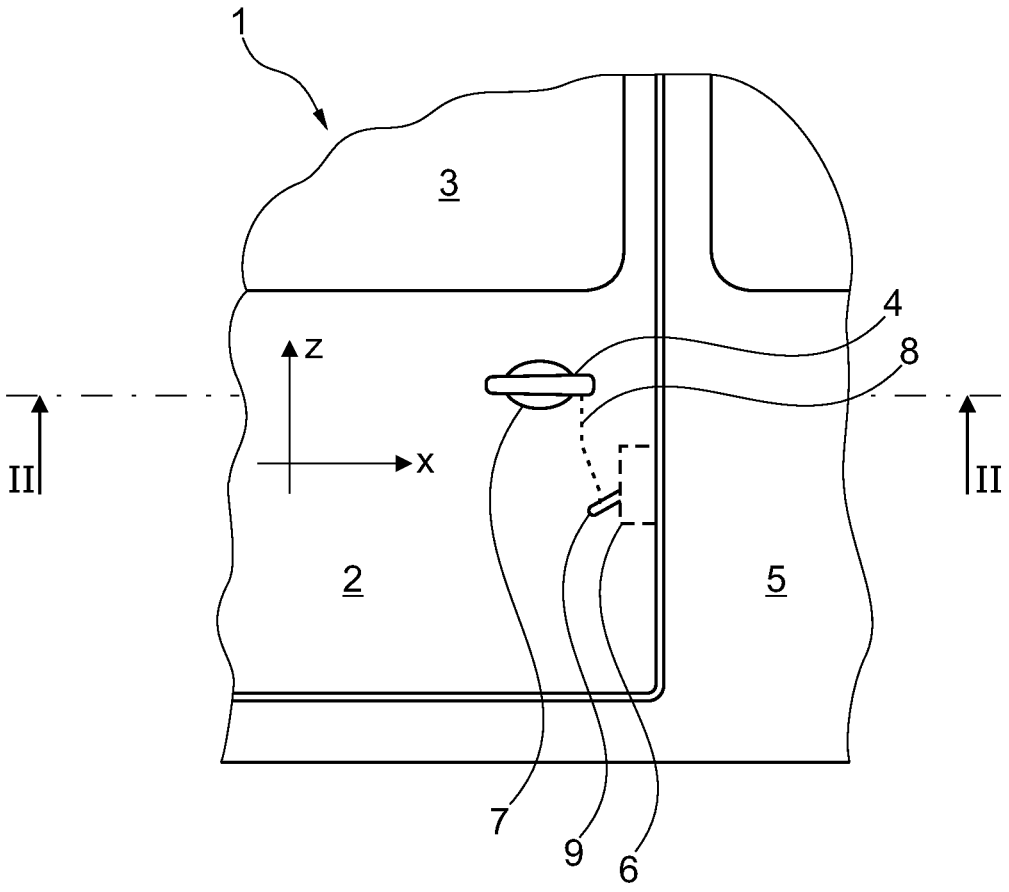
FIG. 1 a lateral view on a motor vehicle in the area of a lateral door with a handle, FIG. 2 a cross-section along line II-II from FIG. 1 in the area of the handle and in an unoperated position, FIG. 3 a cross-section along line II-II from FIG. 1 in the area of the handle, whereby the handle is reproduced in a normal operation, and FIG. 4 a cross-section along line II-II from FIG. 1, whereby the handle is illustrated moved out of the guide.

A lateral view of a motor vehicle 1 is shown in FIG. 1. A lateral door is illustrated with a lateral door panel 3 and a handle 4. The motor vehicle lateral door 2 is shown in the closed state and lies flush to a lateral wall 5 of the motor vehicle. The lateral door 2 is held in a closed position by means of a motor vehicle locking mechanism.

In the area of the handle 4 the motor vehicle lateral door 2 has a recess 7 in the form of a depression in the motor vehicle lateral door 2 so that an operator can easily grip the handle 4. The actuating means 8 is reproduced as a dot-dashed line. The actuating means 8 is connected on one side to the handle 4 and in the area of the motor vehicle locking mechanism 6 with an actuating lever 9. The motor vehicle lock 6 customarily interacts by means of a locking mechanism which is not illustrated with a lock holder which is mounted on the lateral wall 5.

Figure 2:
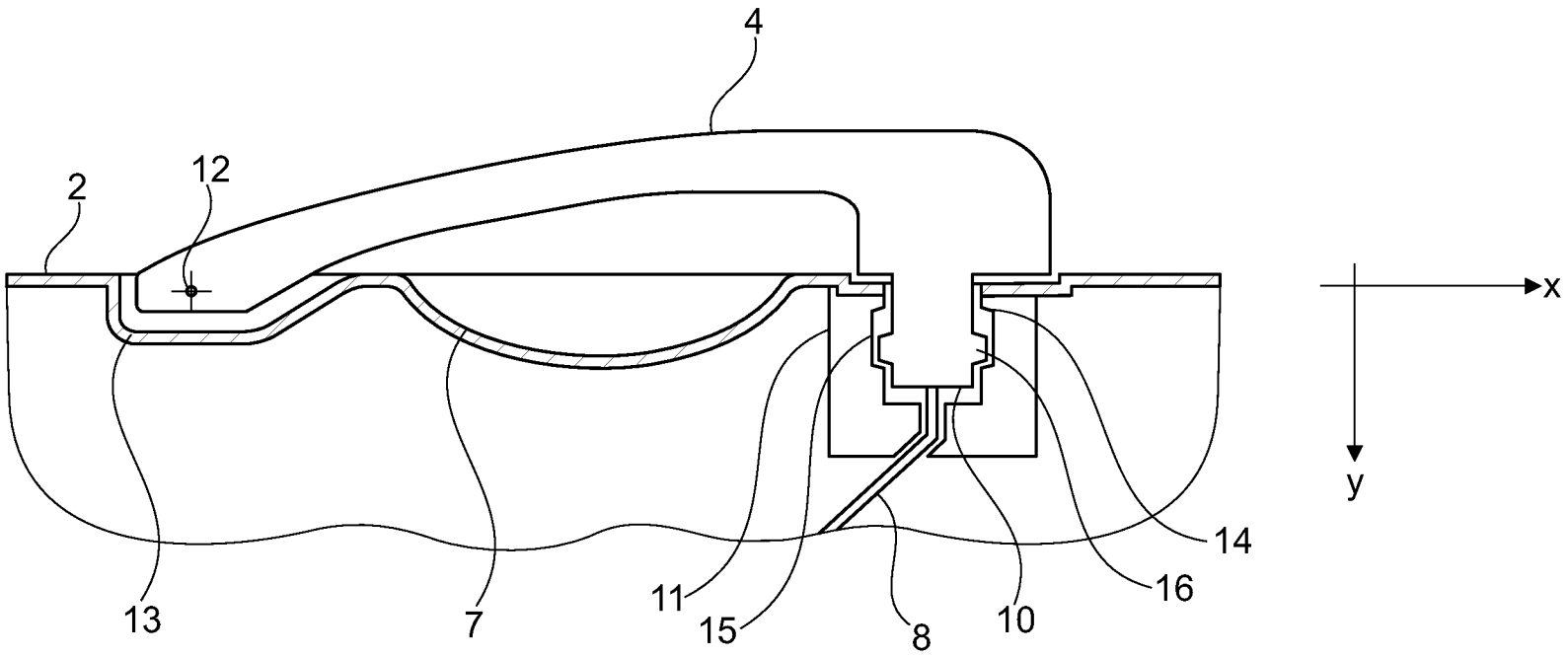

A cross-section along line II-II from FIG. 1 is shown in FIG. 2. The handle 4, the motor vehicle lateral door 2 and the actuating means 8 connected to an extension 10 is illustrated. The extension 10 of the handle is accommodated and mounted in a guide 11. The handle is mounted in the bearing point 12 and accommodated in this exemplary embodiment in a mounting 13 of the motor vehicle lateral door 2.

The guide 11 has a stop 14 which is formed as part of a depression in the guide 11 in this exemplary embodiment. The extension 10 of the handle 4 has an elevation 16 corresponding to the depression 15 so that the handle 4 can be guided in relation to the motor vehicle 1, at least in the direction of the y axis. According to the embodiment and quality of the guidance of the handle 4 one, two or more depressions 15 and corresponding elevations 16 can be arranged in the guide 11. The depressions 15 and elevations 16 are preferably symmetrically arranged on the circumference of the guide 11. A symmetrical arrangement offers the advantage that very accurate guidance of the handle 4 is enabled in the guide 11. Naturally, according to the invention, it is also conceivable that the elevation 16 can be formed on the guide 11 and the depression 15 on the handle 4. Combined arrangements of depressions 15 and elevations 16 in the guide 11 or the handle 4 are conceivable according to the invention.

DETAILED DESCRIPTION

Figure 3:
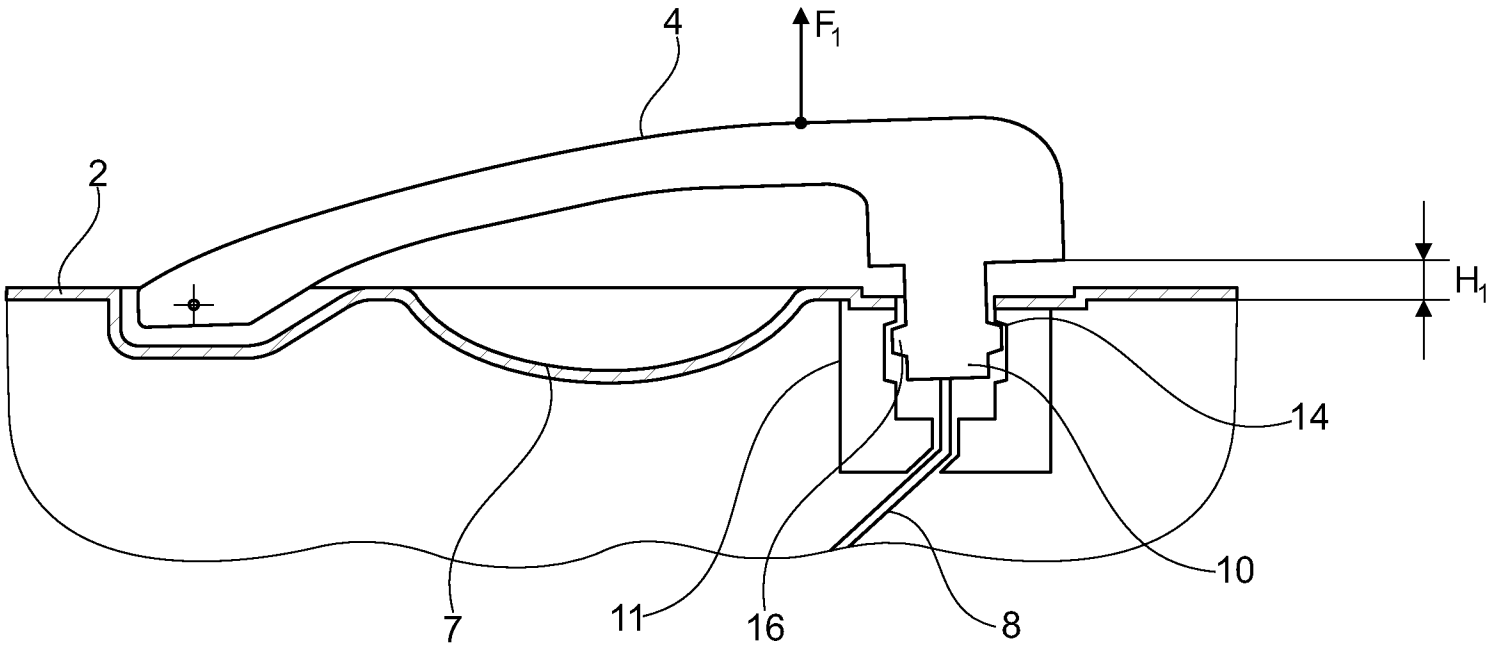

A cut along the line II-II from FIG. 1 is shown in FIG. 3. The position of the handle 4 in an actuating position is illustrated in which the handle 4 completes a stroke H1 by means of which a sensor can be operated, for example, whereby the sensor transmits an electrical signal to the motor vehicle 6 in order to unlock the locking mechanism or the motor vehicle lock 6. The stroke H1 can be a stroke of 2-3 mm, for example. The stroke H1 is attained on the handle 4 by a small force F1 as a tensile force F1. After a stroke H1 the extension 10 and in particular the elevation 16 on the extension 10 reaches against the stop 14 of the guide 11. The stroke H1 produced by pulling on the handle 4 can consequently be limited by the interplay of guide 11 and extension 10 on the handle 4.

FIG. 3 shows an exemplary embodiment in which the stop 14 is form-fittingly formed with the handle 4. A structurally beneficial construction of path limitation enabling limitation of handle 4 movement which can be illustrated with few components of handle can thus be achieved.

Figure 4:
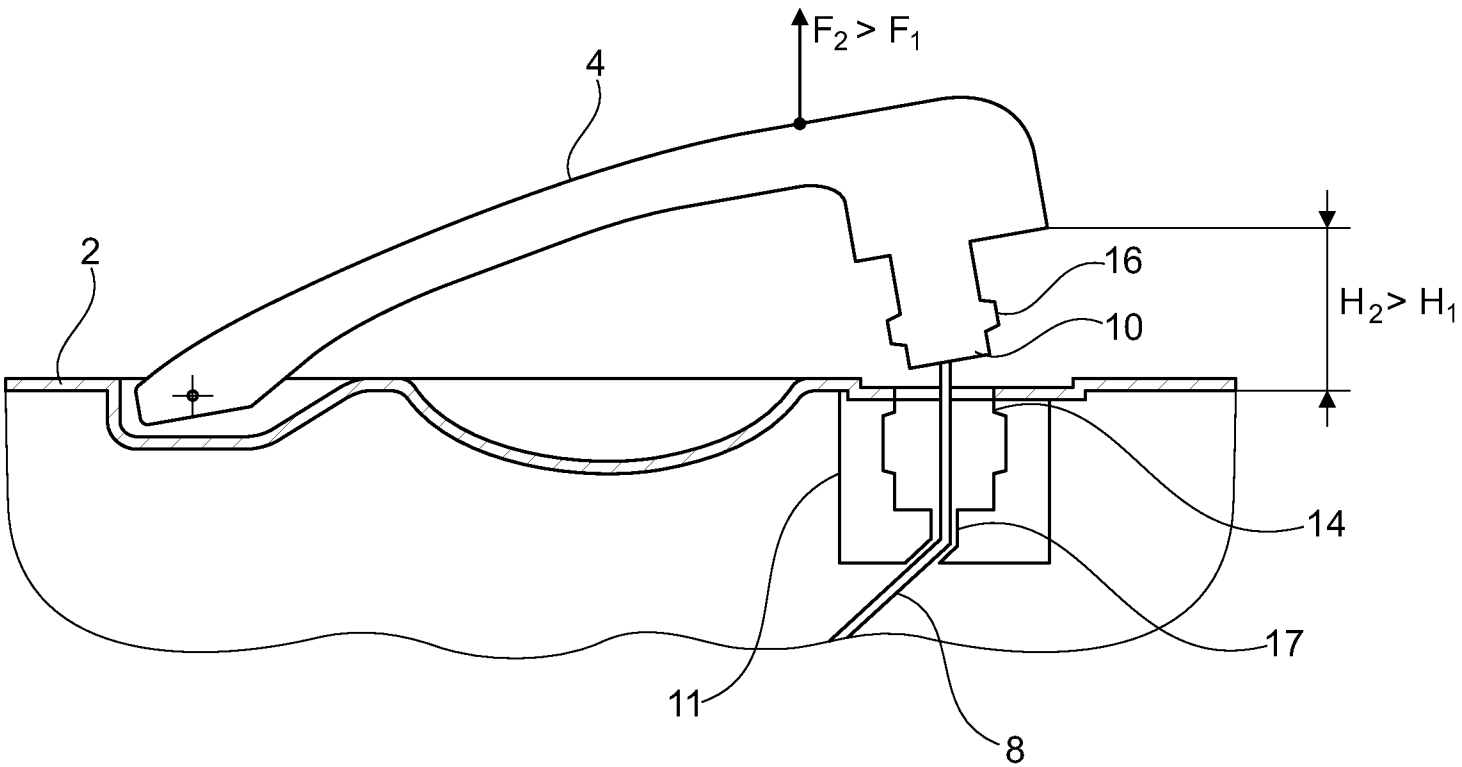

In FIG. 4, an illustration according to line II-II from FIG. 1 is reproduced in turn. The position of the handle 4 in the case of emergency opening in which the handle was pulled out of the engagement area of the guide 11 is illustrated. The elevation 16 on the extension 10 was pulled out above the stop 14 so that the handle is disengaged with the guide and the motor vehicle lateral door 2. The force F2 is considerably greater than the force F1. As is apparent, a very large stroke H2 can be executed with the handle 4 by means of pulling the handle 4 out of the guide 11. The stroke H2 is also considerably greater than the stroke H1 and can be 30 mm, for example.

By means of moving out of the handle or the handle component 4 out of the motor vehicle lateral door a very large stroke can thus be provided to operate the actuating means 8. The actuating means 8 is a cable in the illustrated exemplary embodiment. In addition to the function of the handle guide the guide 11 has a guide contour 17 in the form of a deflection 17 so that the cable 8 can be guided and deflected in the direction of the lock 6, for example.

By means of the large stroke H2, which can also be more than 30 mm and in particular for example 50 mm, play during installation of the cable 8 can be offset and safe operation of the actuating lever 9 can be guaranteed on the lock 6.

REFERENCE SIGN LIST

1 Motor vehicle
2 Motor vehicle lateral door
3 Lateral door disk
4 Handle
5 Lateral wall
6 Motor vehicle locking mechanism, lock
7 Recess
8 Actuating means
9 Actuating lever
10 Extension
11 Guide
12 Bearing point
13 Mounting
14 Stop
15 Depression
16 Elevation
17 Deflection, guide contour
H1, H2 Stroke
F1, F2 Force
X Direction of the x-axis in relation to the motor vehicle
Y Direction of the y-axis in relation to the motor vehicle
z Direction of the z-axis in relation to the motor vehicle

The invention claimed is:

1. An opening device for opening a door or flap on a motor vehicle, the opening device comprising:

a handle that a user can grip from outside the motor vehicle;

a motor vehicle locking mechanism that is unlocked via movement of the handle;

a cable for unlocking the motor vehicle locking mechanism in response to movement of the handle, the cable being arranged between the handle and the motor vehicle locking mechanism; and a guide for the handle fixed to the door or flap, wherein the handle is movably mounted to the door or flap on one side and guided in the guide by another side opposite to the one side and to which the cable is connected, wherein the guide has a stop that is engageable with the other side of the handle to limit movement of the handle during a normal opening operation, wherein the other side of the handle is movable past the stop and out of the guide by an excessive force to operate the cable during an emergency operation, the excessive force being larger than a normal force that acts on the handle to unlock the motor vehicle locking mechanism during the normal opening operation, wherein the guide remains in a same fixed position relative to the door or flap during the normal opening operation and during the emergency operation.

2. The opening device according to claim 1, wherein the cable is at least partially made of plastic.

3. The opening device according to claim 1, wherein the cable is at least partially made of flexible wire.

4. The opening device according to claim 1, wherein the stop is formed of a form-fitting and/or force-fitting connection between the handle and the guide.

5. The opening device according to claim 1, wherein the guide has a device to deflect the cable.

6. The opening device according to claim 1, wherein the handle is movable past the stop and out of the guide after release of the handle from the stop.

7. The opening device according to claim 1, wherein the handle has one or more elevations that is formed on the other side and that is guided in one or more corresponding depressions formed in the guide.

8. The opening device according to claim 1, wherein the stop defines an end of travel of the other side of the handle when the other side of the handle engages against the stop when the handle is moved during the normal opening operation.

9. The opening device according to claim 1, wherein the stop is formed proximate an opening for the guide through which the other side of the handle extends.

10. The opening device according to claim 1, wherein the stop is non-deformable as the other side of the handle is moved past the stop.

11. The opening device according to claim 1, wherein the cable is connected to an end face of the other side of the handle.

12. The opening device according to claim 1, wherein the other side of the handle is movable out of the door or flap by the excessive force.

13. An opening device for opening a door or flap on a motor vehicle, the opening device comprising:

a handle that a user can grip from outside the motor vehicle;

a motor vehicle locking mechanism that is unlocked via movement of the handle;

a cable for unlocking the motor vehicle locking mechanism in response to movement of the handle, the cable being arranged between the handle and the motor vehicle locking mechanism; and a guide for the handle coupled to the door or flap, wherein the handle is movably mounted to the door or flap on one side and guided in the guide by another side opposite to the one side and to which the cable is connected, wherein the guide has a stop that is engageable with the other side of the handle to limit movement of the handle during a normal opening operation, wherein the other side of the handle is movable past the stop and out of the guide by an excessive force to operate the cable during an emergency operation, the excessive force being larger than a normal force that acts on the handle to unlock the motor vehicle locking mechanism during the normal opening operation, wherein a guide contour is integrally formed in the guide for receiving the cable whereby the cable extends through the guide.

* * * * *